United States Patent [19]

Foley et al.

[11] Patent Number: 5,011,441

[45] Date of Patent: Apr. 30, 1991

[54] PEDAL OPERATED WATER CYCLE

[75] Inventors: John J. Foley, Lake Oswego; Ralph M. Eide, West Linn; Ranald I. Macdonell, Tualatin, all of Oreg.

[73] Assignee: Recreation Industries Company, Oak Grove, Oreg.

[21] Appl. No.: 582,135

[22] Filed: Sep. 11, 1990

Related U.S. Application Data

[63] Continuation of Ser. No. 334,908, Apr. 7, 1989, abandoned.

[51] Int. Cl.[5] ..... B63H 16/20

[52] U.S. Cl. ..... 440/30; 114/61; 114/283; 440/26

[58] Field of Search ..... 440/26, 27, 28, 29, 440/30, 31; 114/61, 165, 283, 270

[56] References Cited

U.S. PATENT DOCUMENTS

| | | | |
|---|---|---|---|
| 2,238,844 | 4/1941 | Arbeitlang | 114/165 |
| 2,518,808 | 8/1950 | Nadolinski | 440/30 |
| 2,775,950 | 1/1957 | Dearmond | 115/25 |
| 3,083,382 | 4/1963 | Havens et al. | 9/2 |
| 3,257,987 | 6/1966 | Liard | 115/22 |
| 4,427,392 | 1/1984 | Schneider | 440/30 |
| 4,459,116 | 7/1984 | Moore | 440/31 |
| 4,648,846 | 3/1987 | Hsu | 440/31 |
| 4,698,034 | 10/1987 | Anthonijsz | 440/31 |

FOREIGN PATENT DOCUMENTS

| | | | |
|---|---|---|---|
| 2418614 | 10/1975 | Fed. Rep. of Germany | 440/26 |
| 902023 | 4/1945 | France | 440/26 |
| 1076257 | 10/1954 | France | 440/28 |
| 1315814 | 12/1962 | France | 440/26 |
| 2591995 | 6/1987 | France | 440/26 |
| 602270 | 2/1960 | Italy | 440/31 |
| 628156 | 11/1961 | Italy | 440/26 |

*Primary Examiner*—Sherman Basinger
*Assistant Examiner*—Thomas J. Brahan
*Attorney, Agent, or Firm*—Eugene M. Eckelman

[57] ABSTRACT

A main body member is supported by transverse supports on a pair of pontoons. The main body member supports an operator's seat, a cargo rack, a pedal drive propeller assembly, and a rudder. The main body member has longitudinal slots in its surfaces that are associated with longitudinal interior sockets for adjustable engagement with the seat, the cargo rack, a support extension for the pedal drive propeller assembly, and the transverse supports. By means of such adjustable engagement, attachable portions are capable of longitudinal adjustment for establishing the desired trim of the cycle on the water with the operator or operators supported on the seat. Also, the support extension for the pedal drive propeller assembly is capable of longitudinal adjustment to accommodate the stature of the operator or operators after the plane of buoyancy has been established. Furthermore, seat and propeller assemblies for one or two persons are capable of being substituted one for the other. The propeller assembly and rudder are arranged to pivot rearwardly for riding over obstructions and also can be moved to a position above the bottom of the pontoons for moving the cycle up on the beach or a dock. The parts are capable of being assembled and disassembled without the use of tools.

11 Claims, 7 Drawing Sheets

PEDAL OPERATED WATER CYCLE

This application is a continuation, of application Ser. No. 07/334,908, filed April 7, 1989 now abandoned.

This invention relates to watercraft and more particularly is concerned with new and useful improvements in a pedal operated type water cycle.

Water cycles have heretofore been proposed of the type that are manually operated by a pedal driven propeller assembly. Some of these cycles utilize front propeller drives wherein the craft is pulled through the water with the operator facing forwardly. One such cycle is illustrated in U.S. Pat. No. 3,083,382 wherein a pedal operated front propeller drive assembly is supported on a pair of pontoons and an operator's seat is located rearwardly thereof for foot engagement of the pedal drive. Steering is accomplished by a rudder assembly and steering rod. U.S. Pat. Nos. 4,459,116 and 4,648,846 also disclose a water craft structure that is pedal driven. These devices utilize propeller drive assemblies that pivot on a vertical axis to accomplish steering. Since these types of crafts are operated and handled manually, it is important that they be light in weight and compact for handling and storage. It is also important that they have a high degree of safety and efficiency in the water.

SUMMARY OF THE INVENTION

It is an object of the present invention to provide a manually operated, pedal driven water cycle structure that has a combination of features which together form an improvement over prior devices.

More particularly, it is an object of the invention to provide a water cycle that by its structure provides improvements in speed, stability and ease of use. As one feature of the combination, longitudinally adjustable seat means, which may comprise one or two seats, are provided, such longitudinal adjustment being capable of precisely trimming the cycle on the water. The combination also has longitudinal adjustment means for a pedal drive propeller assembly to adjust to the stature of the person seated on the craft. The propeller assembly is readily convertible from a one person drive to a two person drive and vice versa.

Another object is to provide a water cycle that is light in weight and is conveniently assembled and disassembled for ease in carrying and storage. The craft is capable of being assembled and disassembled without tools. The structure further allows the pontoons to be mounted on standard car roof racks.

A further object is to provide a water cycle having structure facilitating longitudinal adjustable support of a cargo rack thereon, such rack being conveniently available to the operator or operators seated on the craft.

A further object is to provide a water cycle having a front pedal drive propeller assembly and a rear rudder assembly that will swing up rearwardly and allow them to ride over obstructions in the water.

Yet another object is to provide an improved pedal drive propeller assembly facilitating efficient use of the operator's muscle power and efficient propeller driving action with the water.

In carrying out the objectives of the invention, a pair of elongated, lightweight parallel pontoons support a main longitudinal body member which in turn supports one or more operator seats, a cargo rack, and a front extension on which the pedal drive propeller assembly is supported, all of such supported members being adjustable longitudinally on the body member to trim the cycle on the water and to accommodate the length of the operator's legs. The pedal drive propeller assembly is supported on a horizontal axis to allow this assembly to ride over obstructions and importantly for efficiency in operation such axis is coaxial with the pedal axis. The propeller assembly can be manually swung upwardly and held in a position above the bottom plane of the pontoons when it is desired to remove the cycle from the water. A rear rudder also is arranged to ride over obstructions. The main body member of the cycle and other component parts have a structural combination that allows for the convenient assembly and disassembly without tools.

The invention will be better understood and additional objects and advantages will become apparent from the following description taken in connection with the accompanying drawings.

BRIEF DESCRIPTION OF THE DRAWINGS

FIG. 5 is an enlarged sectional view taken on the line 5—5 of FIG. 3 and showing rudder support structure.

FIG. 6 is an enlarged exploded sectional view taken on the line 6—6 of FIG. 3 and showing attaching means for the pontoons.

FIG. 7 is a fragmentary elevational view, partly broken away, of the pedal operated propeller drive assembly.

DETAILED DESCRIPTION OF A PREFERRED EMBODIMENT

Figure 1:
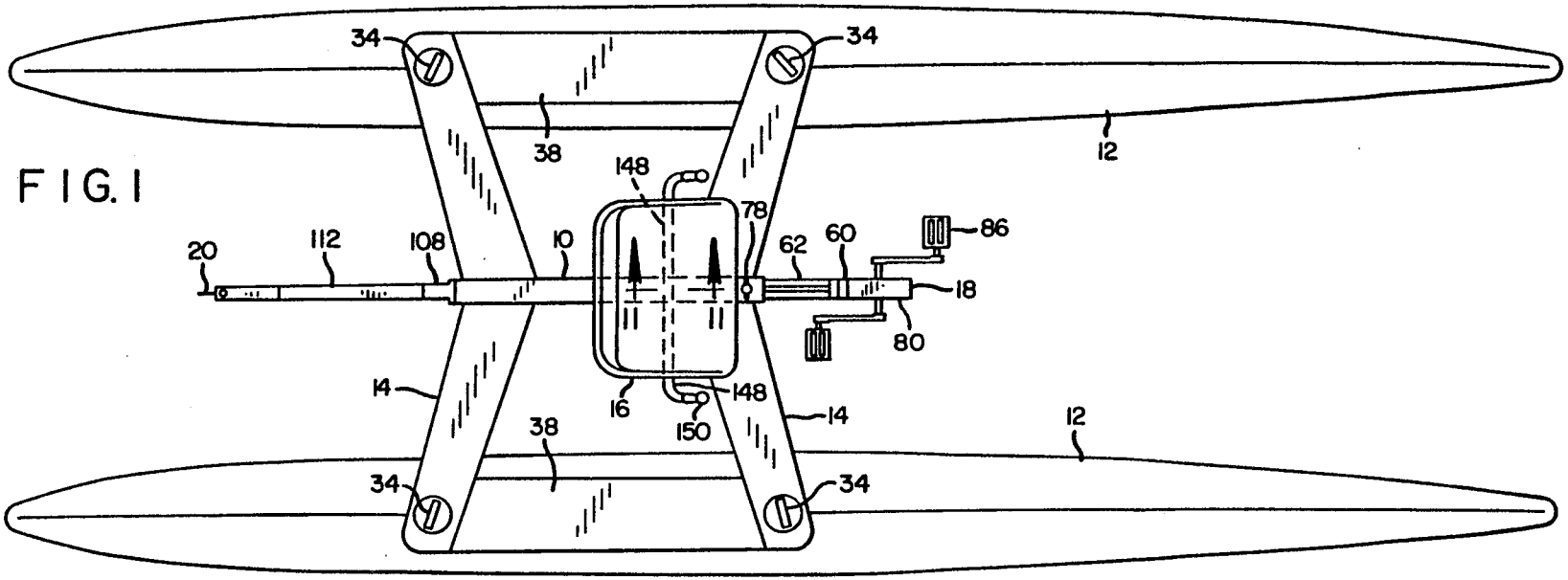
FIG. 1 is a top plan view of the pedal operated water cycle of the invention.
Figure 2:
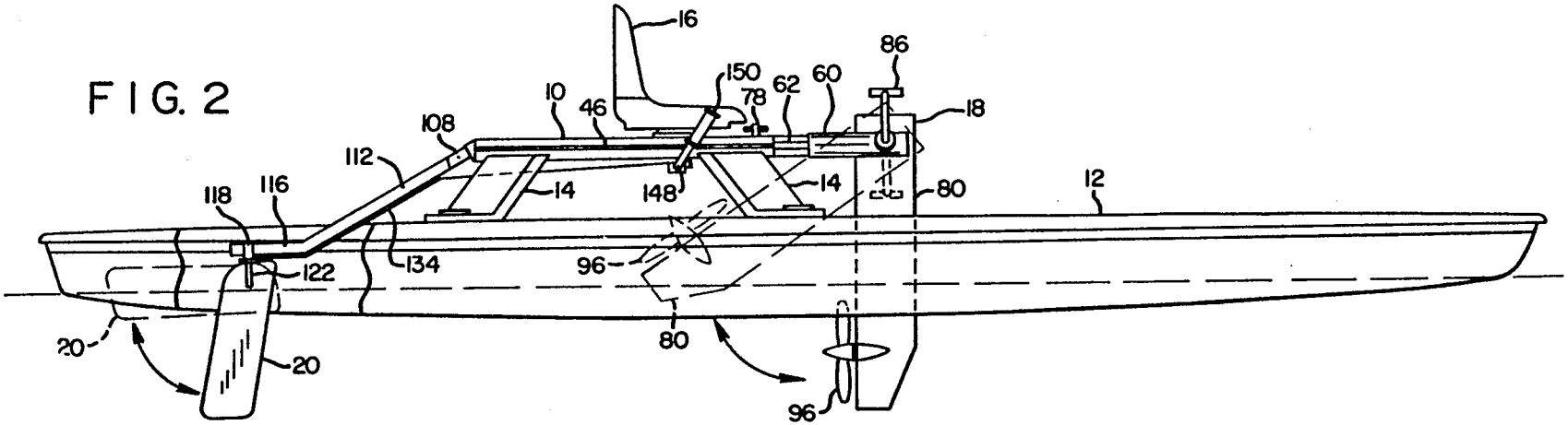
FIG. 2 is a side elevational view thereof.
Figure 3:
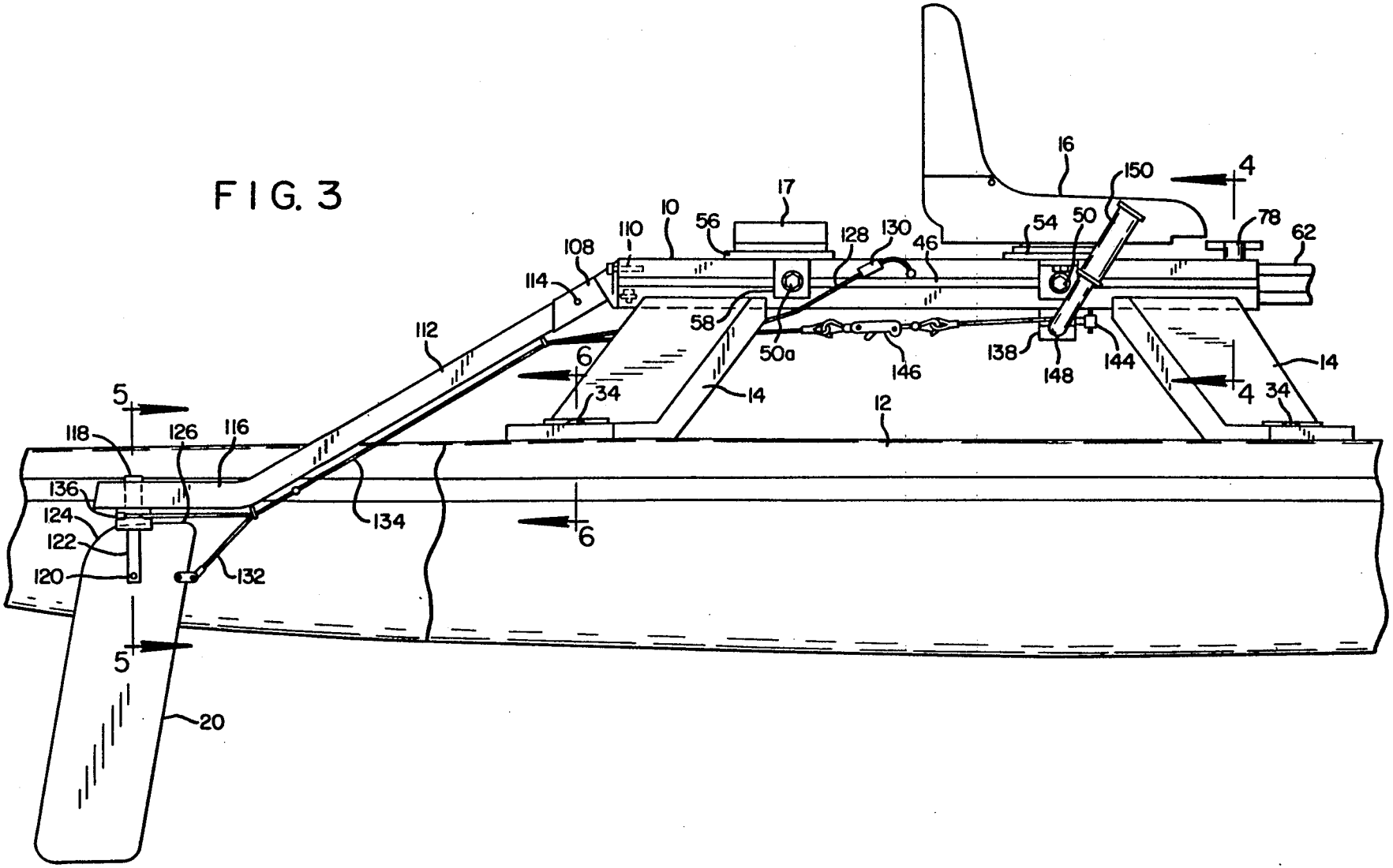
FIG. 3 is an enlarged fragmentary side elevational view.

With reference first to FIGS. 1 and 2, the invention comprises broadly a main body member 10, a pair of parallel pontoons 12, transverse support frames 14 which support the body member 10 in parallel relation with the pontoons and thereabove, a seat member 16, a cargo rack 17, FIG. 3, a pedal operated propeller drive assembly 18 forward of the seat, and a rear rudder assembly 20.

Figure 4:
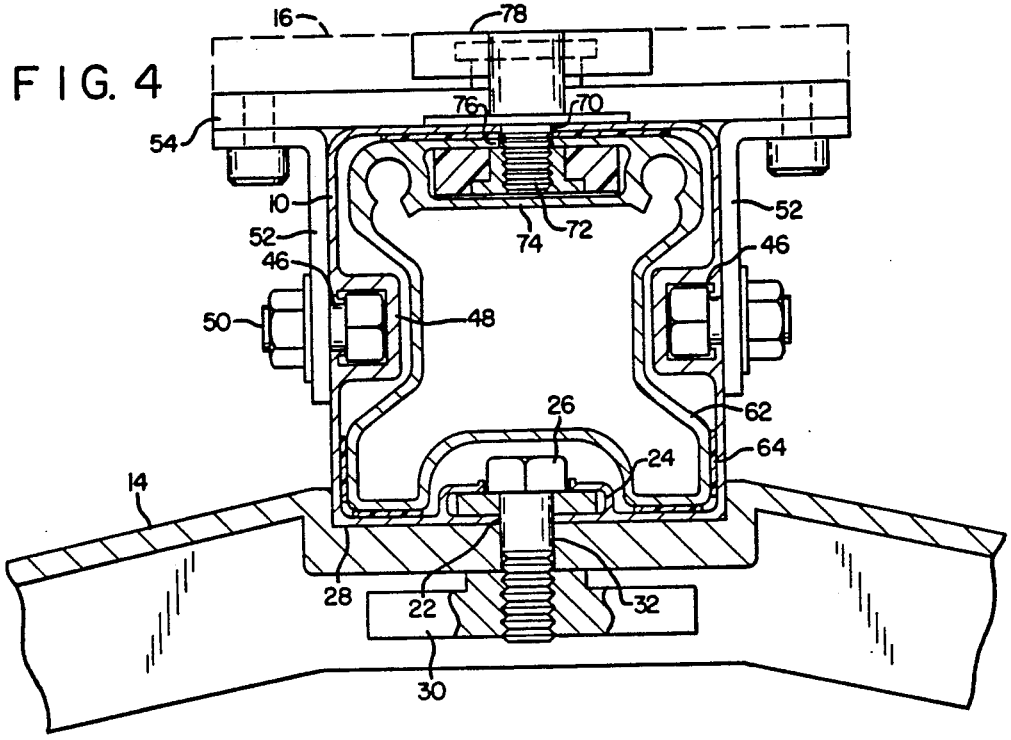
FIG. 4 is an enlarged fragmentary sectional view taken on the line 4—4 of FIG. 3 and showing structural details of the main body member and its attaching structure to various parts of the cycle.

As will be more apparent hereinafter, certain component parts are readily assembled and disassembled for ease of transportation and storage and all of such parts except the support frames 14 and rudder 20 have longitudinal adjustment. For accomplishing such support and adjustment and with particular reference to the cross section view of FIG. 4, the main body member 10 may be tubular in construction and have a longitudinal bottom slot 22 communicating with a longitudinal internal socket 24 enclosing clamp bolt assemblies 26 for securement to the transverse support frames 14. As seen in FIG. 4, the transverse support frames 14 have a recess 28 in their top surface for snug interfitting engagement with the body member 10. Secured clamping engagement of the body member on these transverse support frames is accomplished by hand nuts 30 on the underside of the frames 14, the bolts 26 extending through bores 32 in the support frames for receiving the hand nuts. Hand nuts 30 are enlarged for easy manual on-off engagement with the clamp bolts 26. The longitudinal slots 22 and sockets 24 in the body member 10 allow adjusted longitudinal positioning of the body member on the transverse support frames 14.

Releasable securement of the transverse support frames 14 to the pontoons is accomplished by large headed, hand operated screws 34, FIG. 6, adjacent the ends of the transverse support frames and threadedly engageable in tapped bores 36 in the top of the pontoons 12. The top surface of the pontoons in the area 38 between the transverse support frames is flat and forms a stepping surface. The pontoons 12 comprise hollow water-tight compartments to provide buoyancy but also contain a buoyant material 40 sufficient to maintain the cycle afloat in the event of damage to the pontoons.

The main body member 10 has longitudinal side slots 46, FIGS. 2, 3 and 4, communicating with longitudinal internal sockets 48. Sockets 48 are arranged to receive clamp bolt assemblies 50 which project through the slots 46 and engage brackets 52 that support a base 54 for the seat 16. Base 54 is of a conventional construction with means allowing swiveling movement of the seat on a vertical axis and snap-off mounting of the seat on the base. Such swiveling support facilitates easy mount and dismount of the operator onto and off the cycle. The seat 16 is adjustable longitudinally of the main body member by loosening the bolt assemblies 50 and sliding it to the desired position of support on the body member. Thus, the desired trim for the cycle with a person supported on the seat can be established by longitudinal adjustment of the body member 10 on the members 14 and by longitudinal adjustment of the seat on the body member.

Cargo rack 17, seen only in FIG. 3, is supported on a base 56 in turn supported on brackets 58 similar to brackets 52 for the seat and having longitudinal adjustable securement to the body member 10 by bolt assemblies **50*a* mounted in the slots 46. Longitudinal adjustment of the cargo rack also is used for trimming the cycle on the water. Similar to the seat support, the cargo rack has snap-off support on its base 56**.

Figure 10:
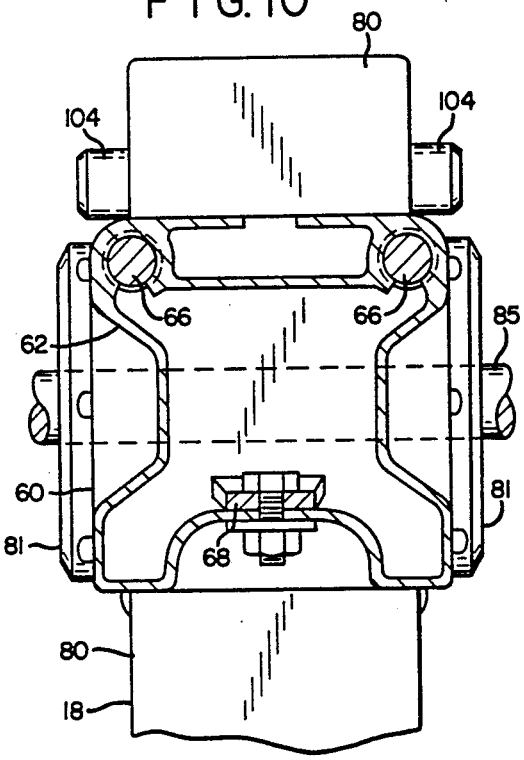
FIG. 10 is an enlarged sectional view taken on the line 10—10 of FIG. 7 and showing mounting structure between the main body member and the pedal operated propeller drive assembly.
Figure 8:
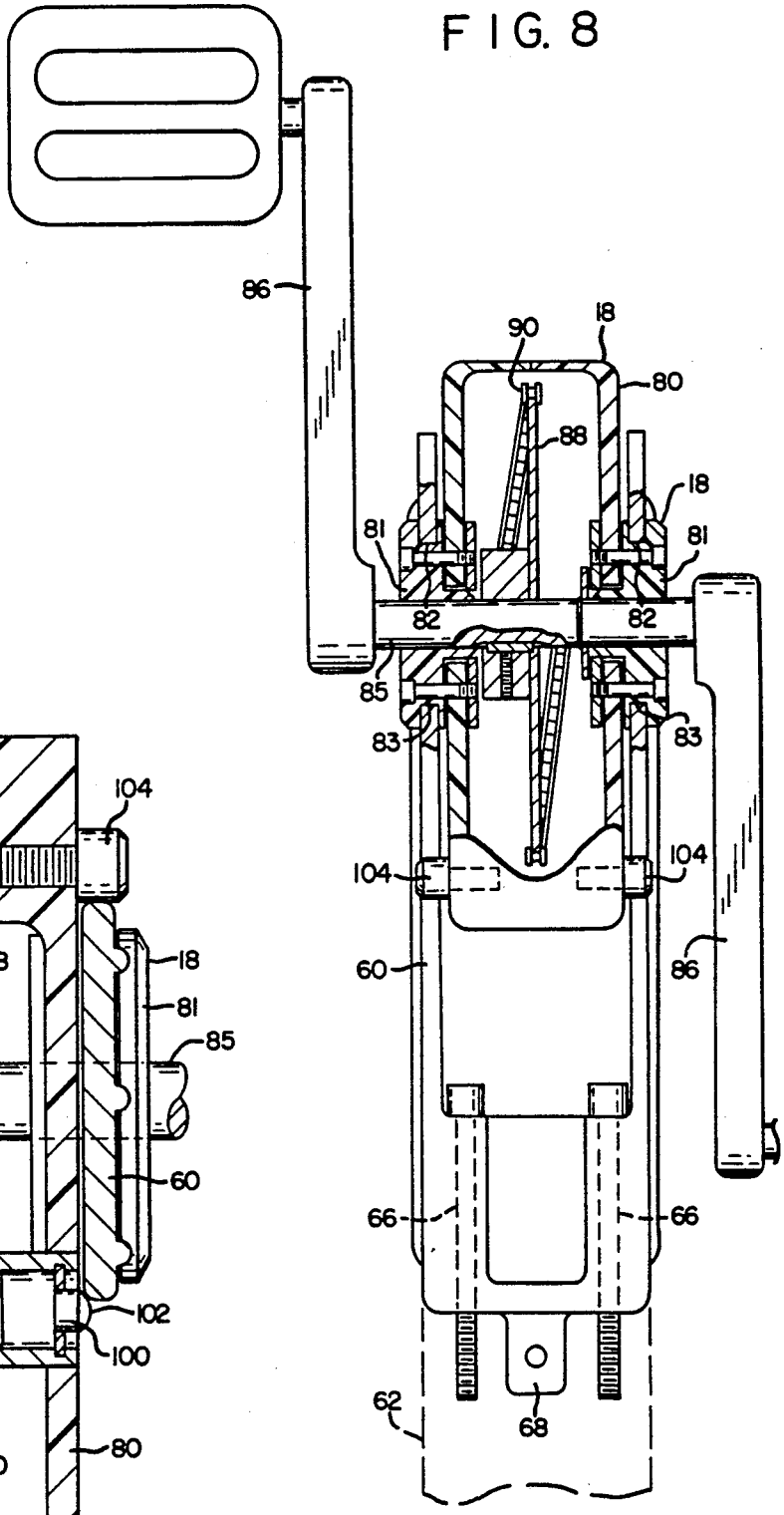
FIG. 8 is a horizontal sectional view partly broken away, this view being taken on the line 8—8 of FIG. 7.
Figure 9:
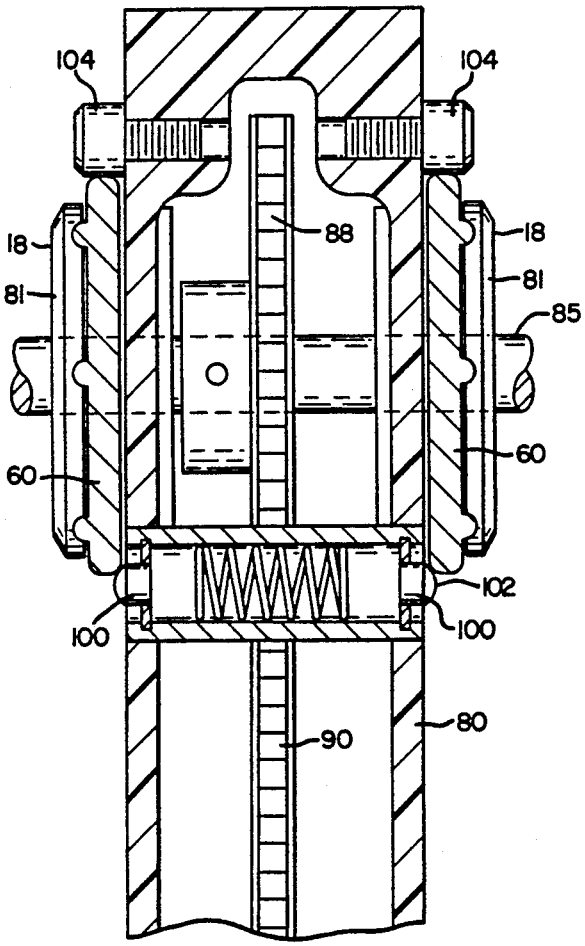
FIG. 9 is a fragmentary sectional view taken on the line 9—9 of FIG. 7.
Figure 8:
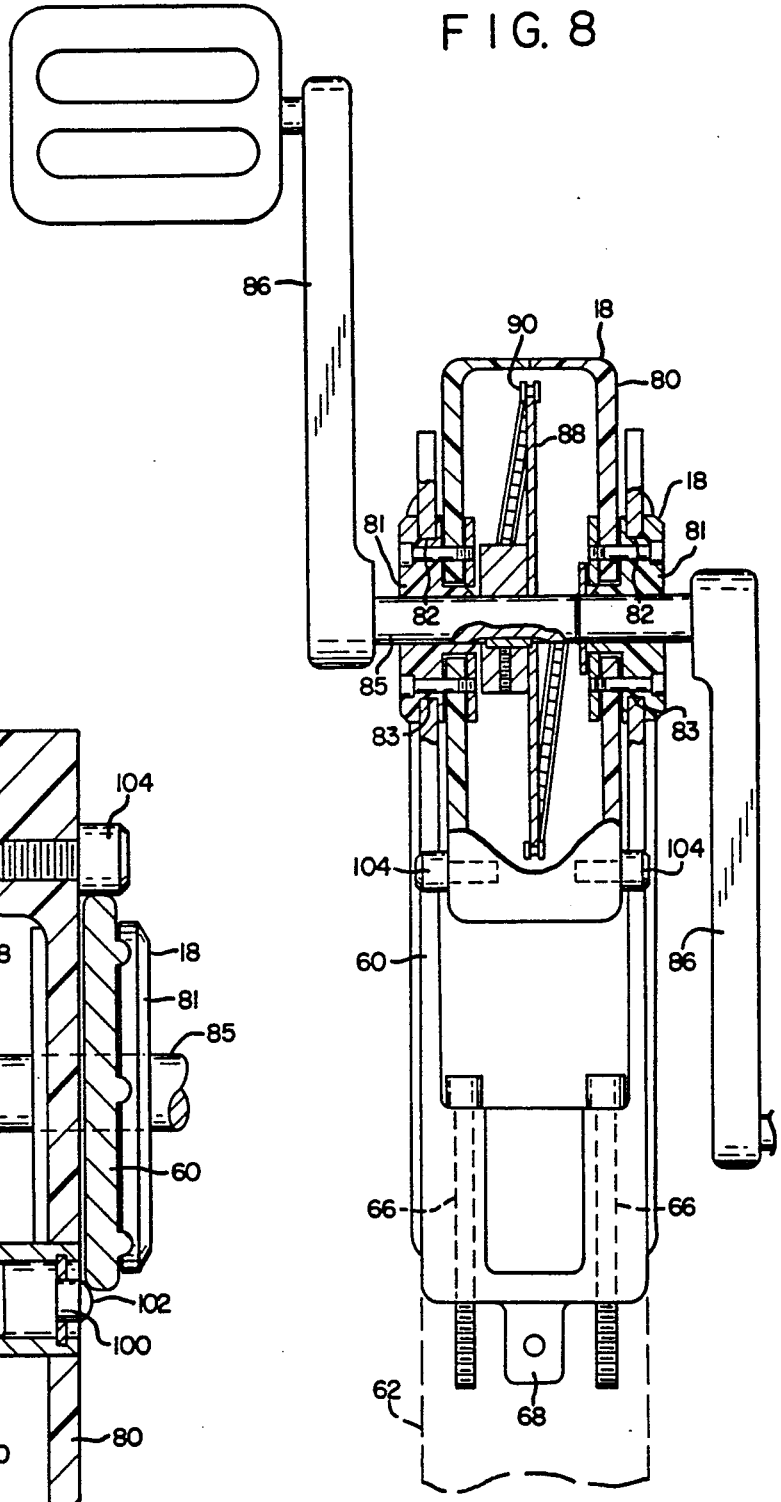
Figure 9:
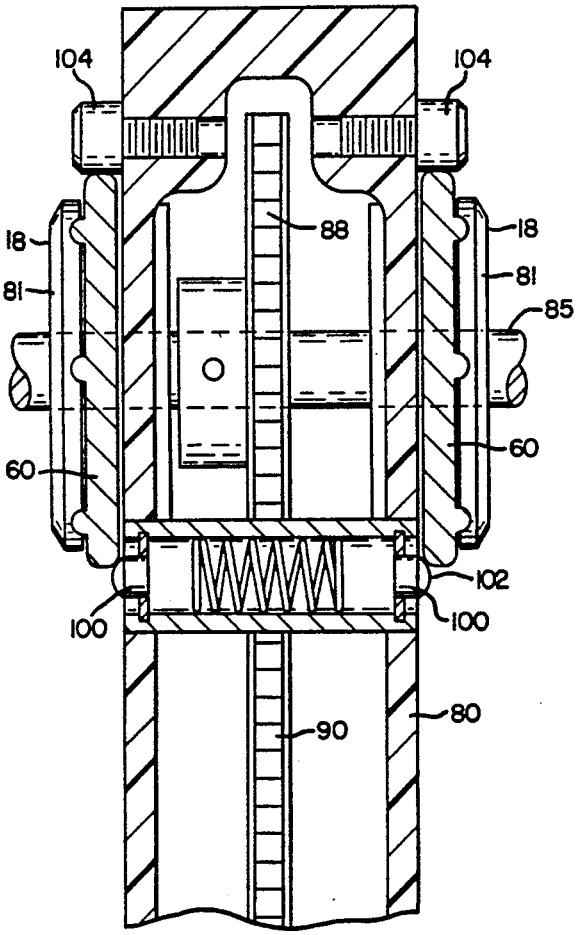

The propeller drive assembly 18 comprises a yoke 60, FIGS. 7, 8 and 9, secured to the forward end of an extension 62 having telescoping interfitted engagement in the front open end of the main body member 10. With particular reference to FIG. 4, the extension 62 is formed with an external wall contour which provides clearance with the longitudinal sockets 24 and 48 of the body member. This extension is stabilized within the main body member in slidable positions by bearing bushings 64 and has secured connection to the yoke 60 by end screws 66, also seen in FIG. 10, and one or more bolted tab connections 68.

Main body member 10 has a top longitudinal slot 70, FIG. 4, for receiving a clamp bolt assembly 72 confined in a longitudinal socket 74 on the interior of the extension and having a top slot 76 in alignment with the body member slot 70. Clamp bolt 72 passes through these slots and receives a top manually operable hand nut 78. The bolt assembly 72 is positioned just forwardly of the seat for convenient turning of the hand nut by the operator when he or she is on the seat. By releasing and tightening of the hand nut 78 the extension 62 can be positioned selectively in telescoping relation in the main body member, the purpose of which will become more apparent hereinafter.

Yoke 60 supports an upright foil shaped drive housing 80, FIGS. 1, 2, and 7–9, by means of opposite hubs 81 seated in yoke sockets 82 having a reduced top opening 83. Hubs 81 in their engaging support portion with the sockets 82 have a flat side 84 forming a diameter segment that has a dimension less than the span of the top reduced socket opening 83. Thus, the hubs 81 and the housing 80 are installed or removed by rotating the housing such that the flat side of the hubs is vertical whereby the hubs will pass through the reduced opening. In normal operating positions of the housing, the flat segments 84 are not vertically aligned with the one edge of the reduced opening 83 and the hubs are locked in the sockets for rotation. Hubs 81 support a cross shaft 85 for pedal members 86. Drive housing 80 has depending pivotal support with the hubs 81 on the shaft 85 and thus its axis of support is coaxial with the pedal axis. Shaft 85 has a sprocket wheel 88 keyed thereto having driving engagement with an upright drive member 90 such as a bicycle type chain or belt in turn having driving engagement at the bottom of the housing with a sprocket wheel 92 secured on a longitudinally extending shaft 94 for a propeller 96. Drive member 90 has a quarter turn to accommodate the two sprocket wheels. If the drive member is a bicycle type chain, it has short links to provide the flexibility necessary to accommodate the 90° turn.

Drive housing 80 has spring pressed detents 100 projecting from its side edges immediately below the bottom edge of the yoke 60. These detents have an outer rounded face 102 which upon selected tangential pressure thereagainst by the bottom edge of the yoke will drive the detents inwardly and allow the drive housing to pivot rearwardly relative to the yoke. Such rear pivotal movement is shown in broken lines in FIGS. 2 and 7. Pivotal movement of the drive housing in the opposite direction, namely, in a counterclockwise direction as viewed in FIG. 7, is prevented by fixed stops 104 mounted on the housing 80 at the upper portion thereof and engageable with the top edge of the yoke. When the propeller is being operated to drive the cycle forwardly, namely, a pulling action on the cycle, the drive housing 80 will by forces of the propeller and also by engagement of the permanent stops 104 with the top edge of the yoke 60 maintain a vertical position. It is desired that the friction forces of detents 100 be sufficient to also maintain the drive housing upright even though pedaling force has ceased and there is a reaction of water on the drive housing which acts rearwardly. However, it is desired that such friction force be releasable in the event that the drive housing should strike an obstruction so that the housing can swing rearwardly and ride over the obstruction rather than be damaged. It is found that a friction holding force of about 10 pounds by the detents 100 provides the desired driving and release positions. Also, this holding force is sufficient to maintain the propeller housing in a down position when the operator pedals in reverse.

The dimensions and position of the yoke and the detents 100 are such that upon an extended swinging of the drive housing rearwardly and upwardly, the detents will move up above the top edge of the yoke 60. As this occurs, the detents snap out and hold the drive housing in the up position. This position holds the bottom of the housing in a plane above the bottom of the pontoons. Thus, the device can be dragged up on a beach or a dock without damage to the propeller. Also, in this swung back position of the drive housing, the flat side 84 of the hubs travels a short distance past the adjacent edge of opening 83, thus maintaining the hubs in the sockets 82. The drive housing is lowered for the next driving function by forcefully pushing it downward until the detents snap out under the bottom edge of the yoke.

The rearward end of the main body member 10 has a socket member 108, FIG. 3, attached thereto by screws 110 or the like in a connection similar to the connection of the yoke 60 to extension 62. This socket angles downwardly for supporting a rearwardly and downwardly extending rudder strut 112. Strut 112 has releasable snap-in engagement with the socket 108 by suitable spring pressed snap fasteners 114. The rearward end of the strut 112 has a horizontal extension 116, also seen in FIG. 5, supporting an upright spindle 118 for the rudder 20. The rudder is supported on this spindle by a horizontal pivot 120 spaced a short distance down from the top of the rudder. The spindle includes a yoke-like portion 122 for the rudder, and the top of the rudder and the defining edge of the yoke are such that a rounded portion 124 of the rudder will allow the rudder to rotate clockwise in the yoke but a straight portion 126 thereof will hold the rudder upright against counterclockwise rotation.

The rudder is held against clockwise rotation under normal conditions by an anchor line 128, FIG. 3, having a releasable securement 130 at its upper end to the main body member adjacent the seat and connected at its opposite end to a front portion of the rudder. It is desired that the rudder, similar to the propeller drive assembly, be capable of swinging rearwardly for riding over obstructions, and for this purpose, the anchor line 128 is provided with an elastic portion 132 which while having sufficient tension strength to hold the rudder upright has sufficient elasticity to allow the rudder to swing rearwardly an amount to ride over an obstruction. In the event that it is desired to swing the rudder to a horizontal position, as seen in phantom lines in FIG. 2, as when it is desired to pull the boat up on the beach or a dock, the anchor line 128 is released at the point of securement 130.

Figure 11:
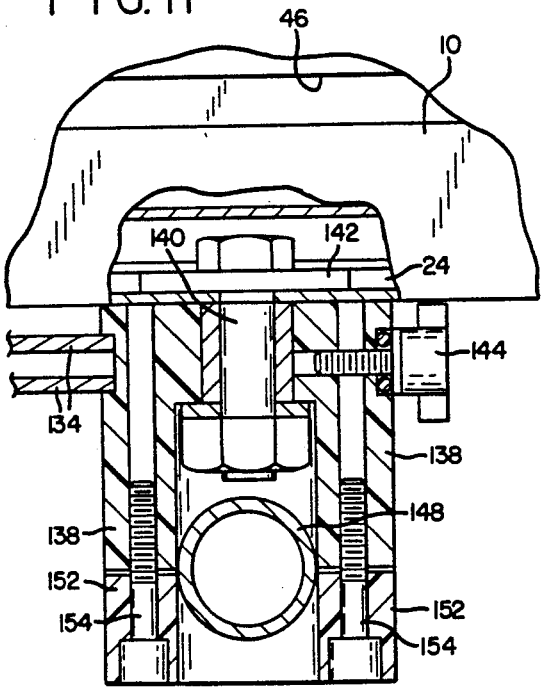
FIG. 11 is an enlarged fragmentary sectional view taken on the line 11—11 of FIG. 1 and showing rudder steering structure.

Rotation of the rudder on its spindle 118 for guiding the water cycle may be accomplished by a steering line 134, FIG. 3, in a first form of structure, engageable with a drive capstan 136, FIG. 5, secured on the rudder spindle 118 and a capstan 138, FIGS. 1 and 11, having rotatable depending support from the main body member 10 under the seat 16. Capstan 138 has its turning support on a spindle 140 supported by a head 142 thereon confined in the bottom socket 24 of the main body member. Steering line 134 has wrapped driving connection with the two capstans and connection thereto by set screws 144 whereby turning movement of the capstan 138 will turn the capstan 136 and the rudder. Steering line 134 has a disconnect 146 therein for disassembly of this line.

Operation of the capstan 138 is by a transverse steering bar 148 having upturned grip portions 150. Steering bar 148 is secured to the bottom of the capstan 138 by a clamp plate 152 secured by screws 154, the bottom of the capstan and the top of the clamp plate being contoured for friction engagement of the bar. By selected tightening of the screws 154, the steering handle 148 can be anchored non-rotatably for normal operation but if desired it can be forcefully rotated to position the grips 150 to the position desired by the operator.

Figure 12:
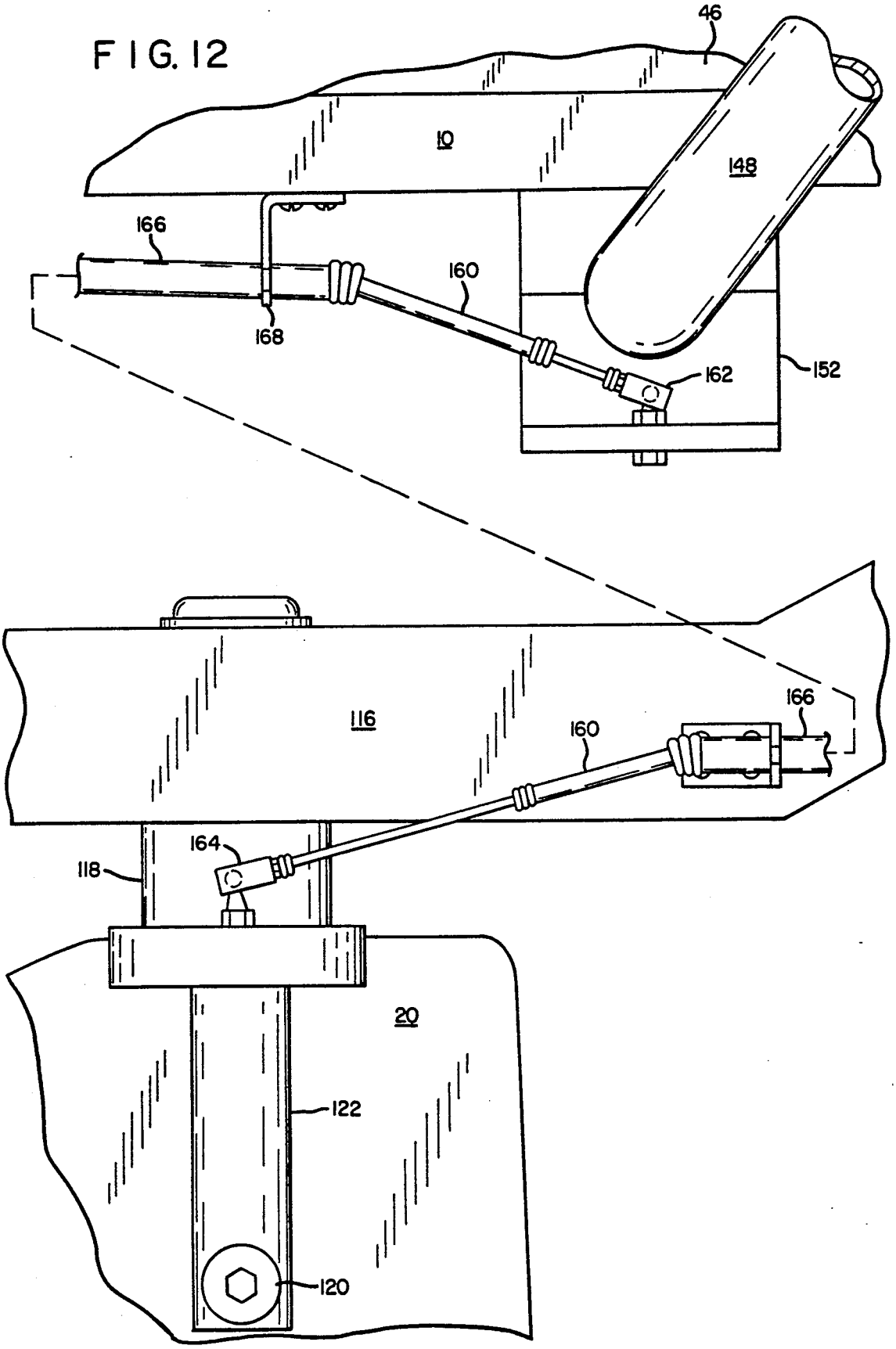
FIG. 12 is an elevational view showing a cable steering assembly for the rudder.

A second form of steering utilizes a conventional flexible push-pull cable assembly 160, FIG. 12, instead of a capstan drive. The push-pull cable is connected at its front end by a spring loaded ball joint disconnect 162 on one side of the bottom handle bar clamp plate 152. The rearward end of the flexible push-pull cable is connected also by a spring loaded ball joint disconnect 164 to one side of the rudder spindle 118. The push pull cable assembly includes a cable sheath 166 having a disconnecting support on a depending bracket 168 bolted to the underside of the main body member 10. According to this lever connection pivotal movement of the steering bar 148 moves the push-pull cable to turn the rudder in the desired direction.

Figure 13:
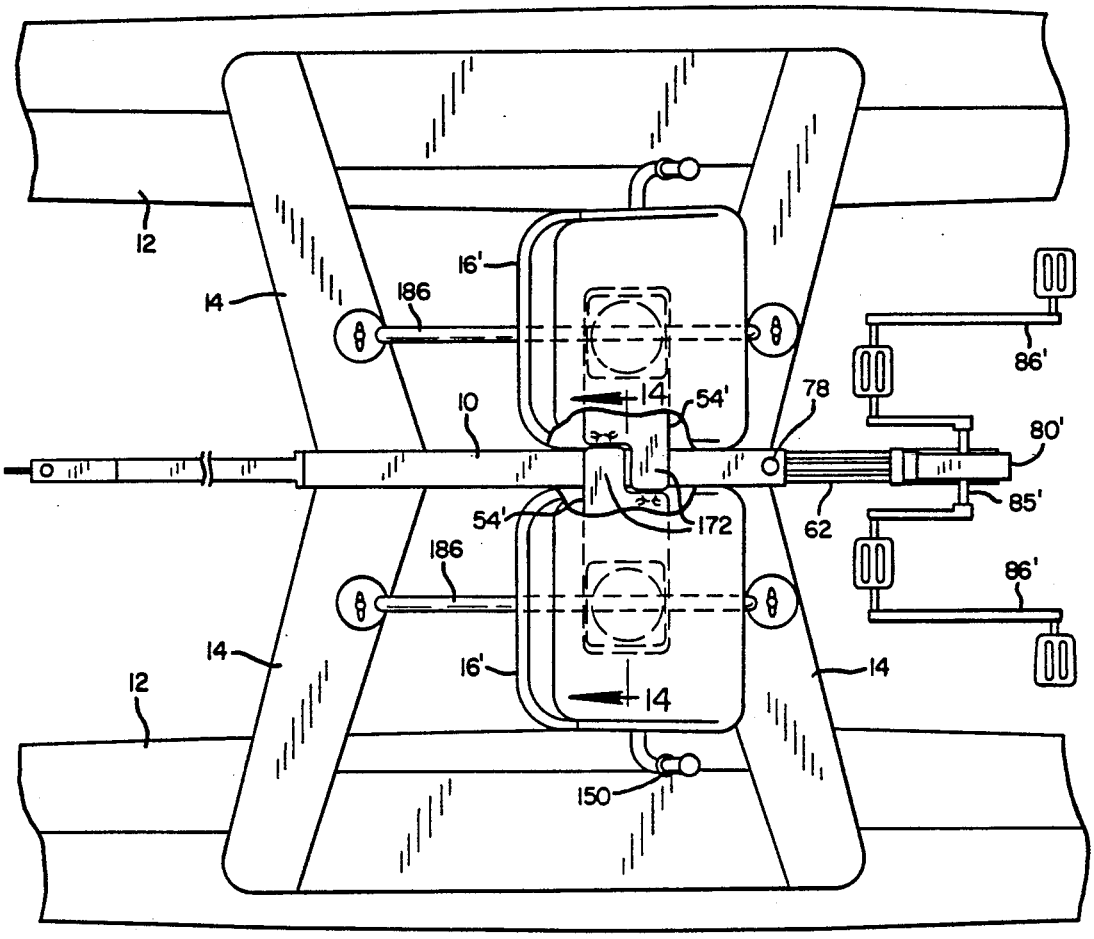
FIG. 13 is a top plan view of a modified seat structure wherein two seats in side by side relation are supported on the body member.
Figure 14:
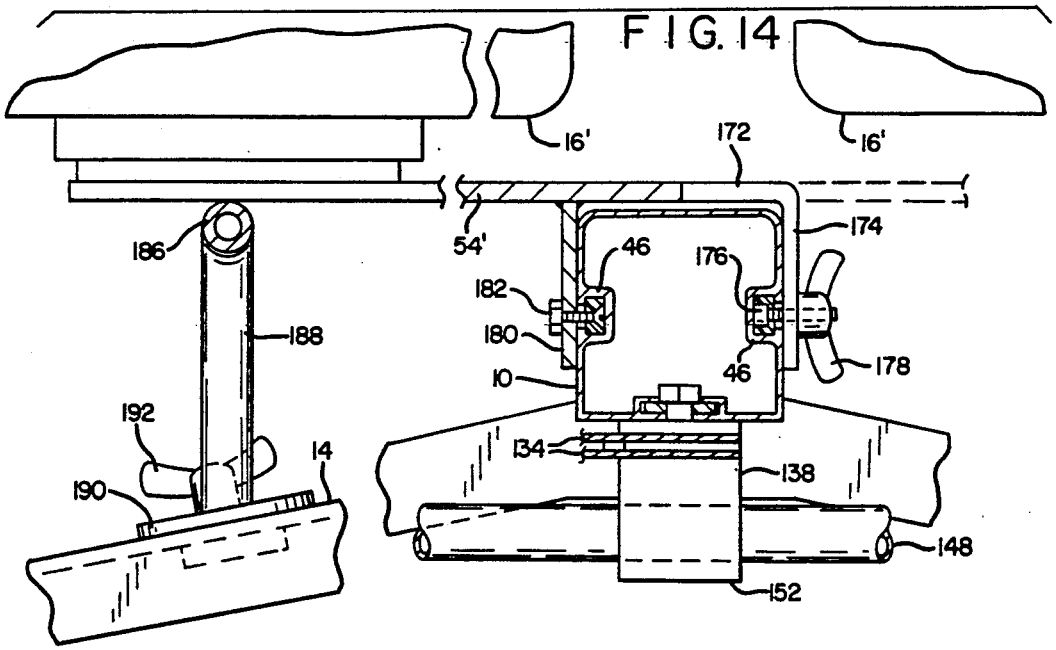
FIG. 14 is an enlarged cross sectional view taken on the line 14—14 of FIG. 13.

FIGS. 13 and 14 illustrate an embodiment of the invention that employs a pair of seats 16' in side by side relation in order that two people can ride the cycle. In this embodiment, a propeller drive housing 80' is employed that has a pair of pedals 86' on a common cross shaft 85'. This shaft and the housing 80' have support hubs engageable in yoke sockets similar to that shown in FIGS. 7–9. Thus, the housing can swing back to ride over obstructions and also can be detached from the yoke in the manner described in connection with the first embodiment.

The seats have individual adjustable support on the body member 10 so that selected individual spacing from the pedals can be made to accommodate two persons of different stature. Each seat has snap-off mounting support on a base plate 54' having an inner side extension 172 with a downturned portion 174 that projects along the side wall of the body member opposite from its seat. This downturned portion is associated with a locking bolt assembly 176 engageable with the longitudinal side slot 46 of the body member. Bolt assembly 176 has an enlarged wing nut 178 for manual loosening and tightening. The base plate 54' thus extends over and rests on top of the body member 10 and is arranged to be clamped in adjusted longitudinal positioning on the body member by the bolt assembly 176. An integral depending flange 180 is provided on the base plate on the same side as the seat and this flange extends down in close but slidable association with body member 10. A bolt assembly 182 on the flange 180 engages the longitudinal side slot 46 on that side of the body member and provides stabilizing and guiding functions for the base plate 54'. This bolt assembly is not cinched tight whereby adjustment of the seats is accomplished by loosening and tightening of the bolt assembly 176.

As apparent in FIG. 13, the two end extensions 172 are offset from each other for extending across the body member. For adjusting the seats to different distances from the pedals, the smaller stature person will be seated on the seat that has the forwardly disposed extension 172, namely, the left-hand seat in FIG. 13. This person will make the desired adjustment relative to the pedals and then the other person if necessary can adjust the other seat rearwardly.

Base plates 54' have slidable support at outer portions thereof on longitudinal horizontal members 186 supported on upright posts 188 integral therewith and removably attached at the bottom to transverse support frames 14 by releasable clamp assemblies 190 having an enlarged manually operable wing nuts 192.

OPERATION

In the operation of the present water cycle, the seat or seats are first adjusted to the particular operator. This is accomplished by first releasing the side bolts 50 in the FIG. 1 embodiment and the bolt assembly 176 in FIG. 14, and then tightening them when the proper seat position has been determined. Such seat position comprises that position wherein the water cycle is properly trimmed on the water so that it will move through the water with minimum friction. It may also be necessary to adjust the cargo rack 17 on the body member and to adjust the body member 10 itself longitudinally on the members 14 to complete trimming of the cycle. The pontoons have a narrow profile, they are tapered to the front, and they have a rounded bottom surface whereby to minimize friction engagement with the water.

When the precise trim has been obtained by selective positioning of the body member, seat and cargo rack, as will be determined by the stature of the person riding the cycle and by the load on the cargo rack, the propeller assembly is then adjusted longitudinally relative to the seat or seats to accommodate the most efficient pedaling function of the operator or operators. Such adjustment is accomplished by releasing the hand nut 78 just forward of the seat and moving the extension 62 and its integrated propeller assembly to the selected position in the main body member. The hand nut 78 is tightened when the proper longitudinal positioning of the pedals is found. In the two person embodiment of FIGS. 13 and 14, one or both seats can be adjusted longitudinally as necessary.

By the selected positioning of the seat or seats to maintain the best trim of the cycle and to position the propeller assembly to the preferred position, the best possible efficiency is obtained both for traveling of the cycle through the water and for muscle power of the operator or operators in operating the propeller. The swiveling seat structure allows easy access by the operator or operators to the cargo rack, and also for mounting and dismounting.

In the event that the propeller assembly or the rudder should strike an obstruction, these parts will pivot rearwardly to ride up over the obstruction. The elastic support of the rudder 20 will automatically bring it back into place. The propeller assembly can drop back down by gravity but if necessary the operator can merely reach down and push it to its vertical position as frictionally held by the spring detents 100. In the event that the propeller becomes fouled, the close proximity of the propeller assembly to the seat allows the operator or operators to reach down and clear it, whereby the operator or operators can continue on their way without having to get off the cycle and into the water and without losing much time.

The particular structure of the main body member and its component parts facilitates easy disassembly for transportation and storage. That is, the drive housing 80 is readily removed from the extension 62, the rudder strut 112 is removed from the sockets 108, the steering line 134 of FIG. 1 is disconnected at 146 or the cable 160 of FIG. 12 is disconnected at its ends, the body member is detached from the transverse support members 14, the seat or seats and cargo rack are snapped off, and the support members 14 are disconnected from the pontoons. The support posts 188 of FIG. 14 are removable. For safety of operation, it is preferred that the extension 62 not be removable forwardly from the body member 10. It can be telescoped to a full inner position in the body member for compaction. All of these parts are assembled and disassembled or compacted without the use of tools. The basic unit comprising the pontoons and longitudinal body member can be readily converted from a one person cycle to a two person cycle and vice versa. The various parts, except the pontoons, can be carried in a vehicle when disassembled and the pontoons can be carried upside down on a conventional car rack fitted with fasteners that engage the threaded bores 36.

It is to be understood that the forms of our invention herein shown and described are to be taken as preferred examples of the same and that various changes in the shape, size and arrangement of parts may be resorted to without departing from the spirit of our invention, or the scope of the subjoined claims.

Having thus described our invention, we claim:

1. A water cycle comprising:

a pair of elongated parallel pontoons having forward and rearward ends, a main body member extending parallel with said pontoons said body member having top, bottom and side wall surfaces, and longitudinal, inset recess portions with outwardly facing openings formed in at least some of said wall surfaces, at least one transverse support frame supporting said main body member centrally between said pontoons and thereabove, forwardly facing seat means, means mounting said seat means on said main body member for longitudinal adjustment for selectively locating a a person on said cycle and providing a desired trim of the cycle on the water, and clamp means engageable with said recess and openings for mounting said seat in its said selected adjusted position longitudinally of said body member, a front longitudinal extension on said main body member adjustable longitudinally relative to a position of said seat means, and an upright pedal drive propeller assembly on said extension adjustable with said extension to a selected pedaling distance from said seat.

2. The water cycle of claim 1 wherein said main body member is adjustable on said transverse support frame, whereby also to be involved in the trim of the cycle on the water.

3. The water cycle of claim 1 wherein said body member includes clamp means engageable with said recesses and openings for mounting said extension in a selected adjusted position of pedaling for the operator.

4. The water cycle of claim 1 wherein said body member includes clamp means engageable with said recesses and openings for mounting said seat in its said selected adjusted position longitudinally of said body member and for mounting said body member selectively on said transverse support frame.

5. The water cycle of claim 1 wherein said body member is tubular in construction, said extension also being tubular in construction and having telescoping engagement in said body member for non-rotative but slidable movement, said extension being selectively contoured in its cross section to accommodate said longitudinal, inset recess portions.

6. A water cycle comprising:

a pair of elongated parallel pontoons having forward and rearward ends, a main body member extending parallel with said pontoons, at least one transverse support frame supporting said main body member centrally between said pontoons and thereabove, forwardly facing seat means, means mounting said seat means on said main body member for longitudinal adjustment for selectively locating a person on said cycle and providing a desired trim of the cycle on the water, a front longitudinal extension of said main body member adjustable longitudinally relative to a position of said seat means, an upright pedal drive propeller assembly on said extension adjustable with said extension to a selected pedaling distance from said seat, and a cargo rack supported on said body member immediately behind said seat means, said cargo rack being adjustable longitudinally on said body member for combining in its adjustment with the adjustment of said seat means to provide said desired trim of the cycle on the water.

7. A water cycle comprising:

a pair of elongated parallel pontoons having forward and rearward ends, a tubular main body member extending parallel with said pontoons and having a forward end, at least one transverse support frame supporting said main body member centrally between said pontoons and thereabove, a longitudinal extension projecting forwardly in telescoping mounted relation from the forward end of said main body member whereby to be adjusted longitudinally, releasable fastening means between said main body member and said extension for securing the latter in selected adjusted positions, an upright pedal drive propeller assembly having lift out connection to said extension for convenient removable mounting of said assembly on said extension whereby a single pedal drive propeller assembly can be substituted for a double pedal drive propeller assembly and vice versa, forwardly facing seat means, mounting means mounting said seat means on said main body member for removable attachment whereby a single seat means can be substituted for a two person seat means and vice versa, said mounting means also providing longitudinal adjustment of said seat means on said main body member whereby the seat means and pedal drive assembly are capable of being adjusted longitudinally on said main body member for proper trim of the water cycle and desired spacing of the pedal drive assembly from the seat means.

8. The water cycle of claim 7 wherein said extension has a front yoke, said yoke having side sockets with restricted top openings, said pedal drive propeller assembly having side hubs arranged for rotatable support in said side sockets, said hubs having a flat edge portion which reduces a portion of said hub to a dimension less than said restricted openings whereby to provide a confined rotatable mounting in said side pockets in a depending position of said pedal drive propeller assembly but allowing release of the latter when it is rotated rearwardly an amount sufficiently to align said flat edge portion with said restricted top opening.

9. A water cycle comprising:

a pair of elongated parallel pontoons having forward and rearward ends, a main body member extending parallel with said pontoons, at least one transverse support frame supporting said main body member centrally between said pontoons and thereabove in longitudinal adjustable position relative to said pontoons, forwardly facing seat means, means mounting said seat means on said main body member for longitudinal adjustment relative to said body member for selectively locating a person on said cycle and providing a desired trim of the cycle on the water, a front longitudinal extension on said main body member adjustable longitudinally relative to a position of said seat means, and an upright pedal drive propeller assembly on said extension adjustable with said extension to a selected pedaling distance from said seat comprising a forwardly facing foil shaped housing, an upper sprocket wheel extending longitudinally in said housing, a laterally projecting pedal shaft engageable with and driving said sprocket wheel, a lower sprocket wheel of reduced size relative to said upper sprocket wheel and extending laterally in said housing, a propeller mechanism driven by said lower sprocket wheel, and quarter turn upright drive means engageable with said upper and lower sprocket wheels.

10. A water cycle comprising:

a pair of elongated parallel pontoons having forward and rearward ends, a tubular main body member extending parallel with said pontoons and having an open front end, said body member having top, bottom and side wall surfaces with longitudinal guide portions formed in at least some of said wall surfaces, at least one transverse support frame supporting said main body member centrally between said pontoons and thereabove, forwardly facing seat means, means mounting said seat means on said main body member for longitudinal adjustment for selectively locating a person on said cycle and providing a desired trim of the cycle on the water, clamp means engageable with said guide portions for mounting said seat in its said selected adjusted position longitudinally of said body member, a front removable longitudinal extension projecting in telescoping relation from the open end of said main body member and being adjustable longitudinally and removable relative to said main body member in non-rotatable engagement with said guide portions, and an upright pedal drive propeller assembly on said extension adjustable with said extension to a selected pedaling distance from said seat.

11. A water cycle comprising:

float means, a body member on said float means having forward and rearward ends, an upright pedal drive assembly on the forward end of said body member, forwardly facing seat means adjacent said pedal drive assembly, said pedal drive assembly having a front yoke, said yoke having side sockets with restricted top openings, said pedal drive propeller assembly having side hubs arranged for rotatable support in said side sockets, said hubs having a flat edge portion which reduces a portion of said hub to a dimension less than said restricted openings whereby to provide a confined rotatable mounting in said side sockets in a depending position of said pedal drive assembly but allowing release of the latter when it is rotated rearwardly an amount sufficient to align said flat edge portion with said restricted top opening.

* * * * *